US006750825B1

(12) United States Patent
Delaveaud et al.

(10) Patent No.: US 6,750,825 B1
(45) **Date of Patent: *Jun. 15, 2004**

(54) MONOPOLE WIRE-PLATE ANTENNA

(75) Inventors: Christophe Delaveaud, Limoges Cedex (FR); Bernard Jecko, Limoges Cedex (FR)

(73) Assignee: Universite de Limoges (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1,082 days.

(21) Appl. No.: 08/428,256

(22) PCT Filed: Apr. 19, 1995

(86) PCT No.: PCT/FR94/01044

§ 371 (c)(1),
(2), (4) Date: May 2, 1995

(87) PCT Pub. No.: WO95/07557

PCT Pub. Date: Mar. 16, 1995

(30) Foreign Application Priority Data

Sep. 7, 1993 (FR) ..... 93 10597

(51) Int. Cl.[7] ..... H01Q 1/36
(52) U.S. Cl. ..... 343/749; 343/752; 343/830
(58) Field of Search ..... 343/700 MS, 829, 343/830, 752, 749; H01Q 9/00, 1/36, 9/38

(56) References Cited

U.S. PATENT DOCUMENTS

| | | | | |
|---|---|---|---|---|
| 3,852,760 A | * | 12/1974 | Reggia | 343/830 |
| 3,967,276 A | * | 6/1976 | Goubau | 343/830 |
| 4,123,758 A | * | 10/1978 | Shibano et al. | 343/830 |
| 4,575,725 A | | 3/1986 | Tresselt | 343/700 MS |
| 4,701,763 A | | 10/1987 | Yamamoto et al. | 343/700 MS |
| 4,896,162 A | * | 1/1990 | Parham | 343/749 |
| 4,994,820 A | * | 2/1991 | Suzuki et al. | 343/847 |
| 5,146,232 A | * | 9/1992 | Nishikawa et al. | 343/829 |
| 5,539,418 A | * | 7/1996 | Egashira et al. | 343/752 |

FOREIGN PATENT DOCUMENTS

| | | |
|---|---|---|
| DE | 3941345 | 12/1989 |
| EP | 226390 | 12/1986 |
| EP | 376643 | 4/1990 |
| FR | 2552938 | 10/1983 |
| FR | 2668859 | 11/1990 |

OTHER PUBLICATIONS

Patent Abstracts of Japan, vol. 10, No. 197 (E–418) (2253), Jul. 10, 1986 (& JP–A 61 041 205 (Nippon Telegr. & Teleph.) Feb. 27, 1986).

* cited by examiner

*Primary Examiner*—Michael C. Wimer
(74) *Attorney, Agent, or Firm*—Greenberg Traurig LLP; Eugene C. Rzucidlo

(57) ABSTRACT

A monopole wire-plate antenna comprising a ground plane (10), a first radiating element in the form of a capacity top (11, 12) adapted to be connected to a generator, and a second radiating element in the form of a conductor wire (14, 14', 15, 15') connecting the capacity top to the ground plane is disclosed. It comprises a plurality of at least one of said radiating elements.

8 Claims, 6 Drawing Sheets

MONOPOLE WIRE-PLATE ANTENNA

BACKGROUND OF THE INVENTION

1. Field of the Invention

The present invention relates to a monopole wire-plate antenna. More particularly, said invention relates to monopole wire-plate antennas; and of the type having a ground plane, a first radiating element in the form of a capacity top adapted to be connected to a generator or receiver by a feed wire, and a second radiating element in the form of a radiating conductor wire connecting the capacity, top to the ground plane.

2. Discussion of Related Art

One such an antenna is disclosed in French Patent A-2, 668,859.

That antenna is formed of two metal surfaces arranged on opposite sides of a dielectric substrate. One of these surfaces, generally the larger one, constitutes the ground plane and the other surface constitutes the top loading. The antenna is fed via the feed wire, formed of a coaxial probe which passes through the ground plane and the substrate and is connected to the capacity top.

This antenna is characterized by the fact that it has an additional active radiating conductor wire which is parallel with the coaxial feed probe and connects the ground plane to the capacity top. This wire provides a return to ground. Such an antenna is the seat of two resonant phenomena, hence the name double resonant antenna which is at times given to it.

The physical parameters of the antenna, namely the permittivity of the electrical substrate, its thickness, the radius of the feed wire, the radius of the radiating wire, the distance between the two wires as well as the shape and dimensions of the capacity top and of the ground plane may, a priori, be of any value. However, the proper operation of the antenna depends on the relations between these parameters which limit the possibility and impose constraints which are at times difficult to satisfy from a technological point of view.

Thus, in order to obtain good matching of the antenna, there is preferably necessary a substrate of very low dielectric constant ($\epsilon_r<2$), a distance between the coaxial probe and the radiating wire which is very small as compared with the emission wavelength ($d<\lambda_o/50$) and a radius of the coaxial probe at least five times less than that of the radiating wire. On the other hand, the shape of the capacity top is practically arbitrary and only its surface is of importance. Furthermore, it is preferable from the point of view of the matching of the aerial that its height is relatively great but does not exceed $\lambda_o/18$. The shape and the dimensions of the ground plane modify the matching of the antenna only to a slight extent when its surface is at least 10 times greater than that of the capacity top, but they may substantially modify the radiation pattern, as in all monopole radiation antennas.

The operation of this antenna results primarily from a phenomenon of coupling between the feed probe and the radiating wire or no cavity resonance mode takes place.

The addition of the radiating wire under the conditions which will be explained below creates a parallel resonance located at a frequency far less than those of the conventional modes of resonance of a suppressed antenna. A suitable selection of the physical parameters of the antenna makes it possible, on the one hand, to effect a proper matching of the antenna to the conventional generators and receivers, that is to say the antenna has an impedance the real part of which is close to a given value, generally 50 ∩, when the imaginary part is cancelled out, and, on the other hand, to obtain a radiation of the so-called monopole type which has the typical characteristics of the radiation of a monopole, namely:

- lobe with symmetry of revolution,
- maximum radiation parallel to the ground plane when it is very large and zero in the axis of the wires,
- linear polarization with electric field in a plane perpendicular to the antenna.

Therefore, while the antenna described in the aforesaid French patent has the advantages over prior art antennas of being relatively simple in design and construction, of having small dimensions as compared with the wavelength of use, of being capable of being properly;matched with a suitable gain, of having a larger pass band than a conventional suppressed antenna and a stable radiation of monopole type as a function of the frequency, of being able to be used in a network, it has, however, certain drawbacks.

In particular, in order to place the antenna under the conditions of monopole radiation, the dimensions of the wires and the distance between the wires must be much less than the signal wavelength $\lambda$, which is source of technological difficulties and fragility, particularly in microwave. Furthermore, for use in low frequencies, the dimensions, although already far less than the wavelength, are still too large for applications in mobile communication. Furthermore, when the substrate used has a dielectric constant which is too different from 1, the antenna is difficult to match and its pass band is relatively small. Finally, the form of the monopole radiation is not easily adjustable, for instance in order to obtain a greater maximum gain or in order to obtain a larger spatial coverage.

The present invention is intended to overcome these drawbacks.

SUMMARY OF THE INVENTION

For this purpose, the object of the invention is a monopole wire-plate antenna comprising a ground plane, a first radiating element in the form of a capacity top capable of being connected to a generator or to a receiver by a feed wire and a second radiating element in the form of a conductor wire conducting the capacity top to the ground plane, the antenna being characterized by the fact that it comprises a plurality of at least one of said radiating elements arranged so that the antenna operates in monopole radiation.

It will be seen from the following that such an arrangement makes it possible to solve the problems which have been pointed out above.

It will furthermore be noted that by the word "wire" there is understood not only a conductor of circular cross section but also one of any cross section, such as, for instance, a ribbon. Similarly, the ground "plane", as well as the capacity top or tops, may be formed of curved surfaces, possibly not parallel to each other, in particular in order to generate a monopole radiation of special shape, for instance narrow with a large maximum gain, or wide with a given sector of illumination.

In one particular mode of operation, the characteristics of the antenna, and particularly the shape of the capacity tops are selected in such a manner as to have, at the same frequency or of several close frequencies, an antenna operating both in the monopole mode and in the conventional dipole modes.

Also in one special embodiment, the antenna of the invention has a plurality of conductor wires.

In particular, the antenna of the invention makes it possible to obtain a monopole radiation and a good matching much more easily and with much less stringent technological conditions than in the prior art.

More particularly, the radiating wires may be arranged symmetrically with respect to the feed wire.

In another special embodiment, the antenna of the invention has a plurality of capacity tops, at least one of the capacity tops being arranged to be connected to the generator.

In this latter case, the antenna of the invention can be fed by a coaxial probe which passes through the ground plane, the feed wire of which is connected to a capacity top and the outer conductor of which connects the ground plane to a capacity top located between the ground plane and the capacity top connected to the feed wire.

An antenna in accordance with the invention which comprises several capacity tops may be arranged to present a broad pass band or to present a plurality of resonant frequencies, or to present a monopole radiation pattern close to a given template.

In the special embodiment, the capacity top is substantially rectangular and the radiating wire is connected in the vicinity of the small side of the rectangle.

It has been found that this arrangement makes it possible to decrease the surface and the height with respect to the ground plane. This condition of operation is very important in the case of low-frequency antennas (typically radio antennas), for which the dimensions of the antennas are important.

The feed wires and the radiating wires can also be loaded by circuit elements which are localized or spread out along the wire.

These elements may be passive linear elements (resistor, induction coil, capacitor, any impedance) or active linear elements, but also non-linear elements. Suitably selected, they make it possible, for instance, to decrease the dimensions of the antenna, to change the signal frequency, or to switch several signal frequencies.

BRIEF DESCRIPTION OF THE DRAWINGS

Special embodiments of the invention will now be described by way of illustration and not of limitation with reference to the accompanying diagrammatic drawings, in which.

DETAILED DESCRIPTION OF THE EMBODIMENTS

Figure 1:
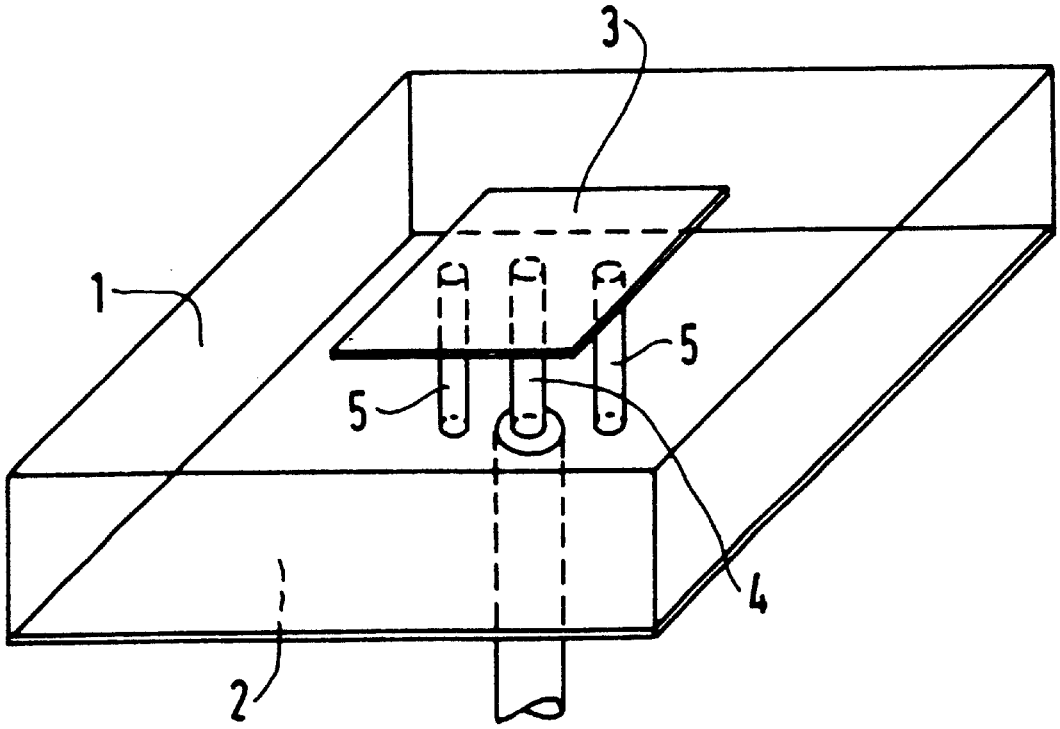
FIGS. 1, 2*a* and 2*b* are three perspective views of three embodiments of the invention.

The antenna of FIG. 1 is formed of a dielectric substrate 1 which is completely metallized on one of its faces 2 in order to form the ground plane and partially metallized on its other face 3 in order to form the capacity top. A coaxial feed probe 4 passes through the ground plane 2 and the substrate 1 and is connected to the capacity top 3. Radiating conductor wires 5 also pass through the substrate 1 in order to connect the ground plane 2 to the capacity top 3.

The radiating wires 5 can be arranged a priori anywhere below the capacity top 3 of the antenna but, depending on their position, their influence on the operation of the antenna will be of greater or lesser importance. Furthermore, the introduction of too large a number of radiating wires (more than four) may attenuate the double-resonant phenomenon and make it unusable from the standpoint of the matching of the aerial to the microwave generators.

Furthermore, the dielectric substrate 1 on which the ground plane 2 and the top 3 of the antenna are arranged is not necessarily formed of a single dielectric material but may be formed of a superpositioning of layers of any dielectric constants. The shape and the dimensions of the substrate 1 are arbitrary but, generally, for practical reasons, their dimensions will not exceed those of the ground plane 2.

The introduction of each additional radiating wire introduces new physical parameters of the antenna, namely the radius of the added radiating wire, its distance from the coaxial feed probe, as well as the distances separating it from the other radiating wires. These additional physical parameters complicate the relations between the physical parameters of the antenna but they actually simplify the problem and reduce the constraints necessary for the obtaining of the operation of the monopole wire-plate antenna.

Thus, the wire of the feed probe 4 need no longer be of a diameter far less than that of the radiating wires but may be of identical or greater diameter. Also, the wires 5 must no longer be located too close to the coaxial feed probe 4 but must preferably be present towards the ends of the top of the antenna. The radius of the wires 5 is preferably less than the radius of the feed probe and the greater the number of the wires 5 or the greater their closeness to the feed probe, the smaller their radius must be.

Compared with a double-resonant antenna having a single radiating wire, the antenna with several radiating wires has generally a larger top and a slightly greatly height in order to operate at the same frequency. However, the introduction of a dielectric medium or of the superimposing of different dielectric media makes it possible to reduce these dimensions. Furthermore, while the double-resonant antenna having a single radiating wire can be suitably matched to 50 ∩ only for substrates of very slight permittivity ($\epsilon_r \leqq 1.2$), the introduction of additional radiating wires makes it possible very easily to match any monopole wire-plate antenna produced on any substrate or combination of substrates.

Furthermore, from a practical standpoint, it is preferable in certain cases to arrange the wires 5 symmetrically with respect to the coaxial feed probe 4 by, for instance, placing said feed;probe in the center of the capacity top 3 of the antenna.

The principle of operation of the double-resonant antenna having several radiating wires is similar to that of the double-resonant antenna having only a single wire. The addition of further supplementary wires does not create new parallel resonances related to each of the radiating wires but modifies the resonance created by one radiating wire.

In fact, in first approximation, it can be considered that the phenomenon of double resonance is henceforth created by the "inductor equivalent" to the totality of the wires 5, which short-circuits the capacitance of the antenna. This inductor is henceforth smaller, in view of the placing in parallel of the inductors related to each of the wires 5, which explains why the resonant frequency is shifted towards the high frequencies and why this resonance has a lower quality coefficient. The introduction of dielectric substrates of strong permittivity causes the resonant frequency to decrease again and increases the quality coefficient by modifying, primarily, the mutual inductances between the wires.

The decrease in the quality coefficient of the double resonance appears very beneficial from the point of view of the matching of the aerial to the microwave generators, since it makes it possible to maintain the real part of the impedance close to 50 ∩ and the imaginary part zero over a larger frequency band, which makes it possible to obtain an increase in the pass band.

These properties are general, and are found again with very different antenna parameters at any operating frequencies. Also, the selection of the frequency of use is at the discretion of the user.

Therefore, the obtaining of a correct matching to a given frequency may be effected in the following manner:

- the surface of the top 3, the height of the substrate or substrates 1 and the number of radiating wires which gives the approximate operating frequency is selected,
- the location of the wires 5, their radius, and the distances between them, which permits an adjustment of the frequency and of the real part and imaginary part of the impedance, and therefore an optimizing of the matching of the antenna are selected,
- the dimensions of the ground plane 2 which determines the radiation pattern is selected.

The monopole wire-plate antenna having several radiating wires has radiation characteristics similar to those of the double-resonant antenna which has only a single radiating wire, namely a radiation of monopole type which takes place via the feed wire and radiating wires.

The multiplying of the wires 5 makes it possible henceforth perfectly to make the radiation symmetrical by arranging the wires 5 symmetrically with respect to the feed probe 4 located in the center of the antenna.

The dimensions of the ground plane 2 and, to a lesser extent, the dimensions of the substrate 1, introduce modifications in the radiation pattern, as in the case of any monopole radiation antenna.

There are given below the characteristics of an antenna of the type of the one shown in FIG. 1 having two wires 5 and a coaxial feed probe 4 of diameter of 1.27 mm, the two wires 5 being arranged symmetrically with respect to the probe 4, and the axis of each of the wires being at a distance of 3.3 mm from the axis of the probe. The electric substrate 1 is formed of a plate of methyl polymethacrylate of 72 mm×72 mm and a thickness of 10 mm and a permittivity equal to about 2.5. The ground plane 2 covers an entire face of the plate 1 and the capacity top is centered on its other face and has the dimensions of 20 m×20 mm.

Figure 3A:
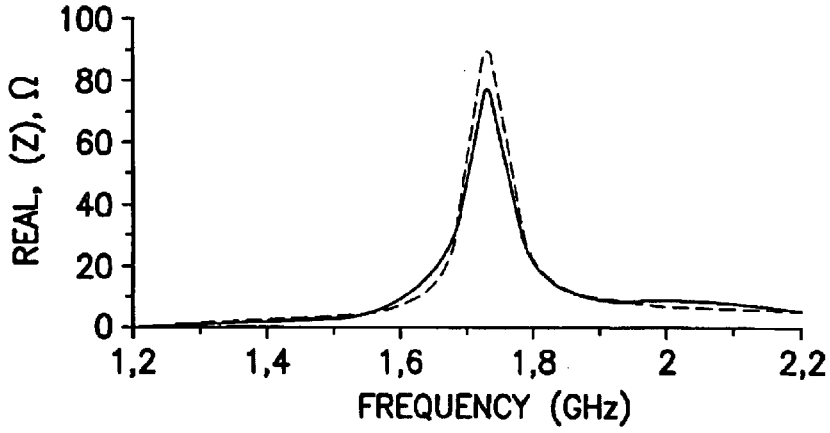
FIGS. 3*a*, 3*b* and 3*c* illustrate the real and imaginary parts of the equivalent impedance Z (f) and the coefficient of reflection $S_{11}$ (f) respectively of an antenna in accordance-with the embodiment shown in FIG. 1.
Figure 3B:
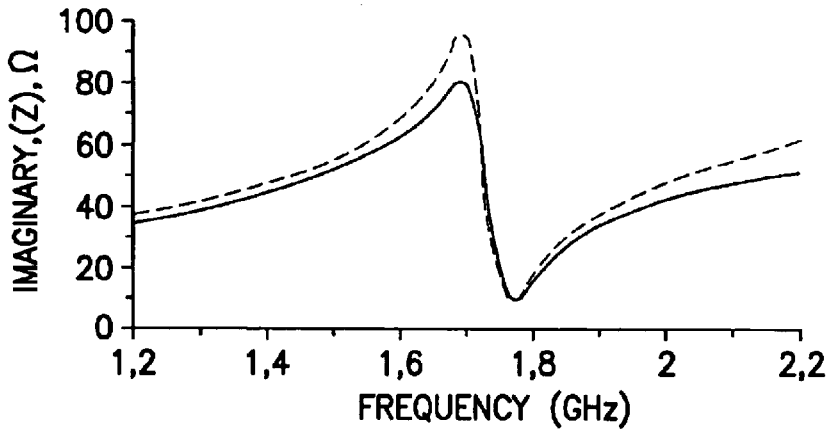
Figure 3C:
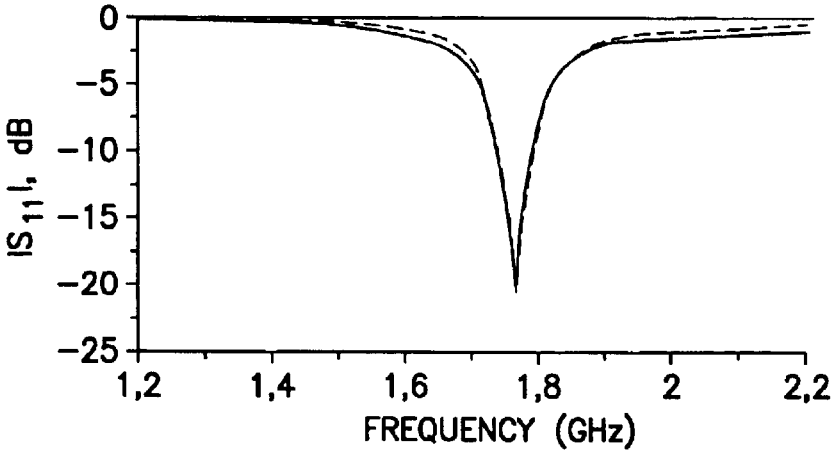

FIGS. 3 to 6 reference to the numerical portion of a Figure encompasses all the sub-figures, collectively, e.g., "FIG. 3", collectively refers to "FIGS. 3*a*–3*c*"). Shows in solid lines the measured values and in dashed lines the theoretical values. FIGS. 3*a* and 3*b* show the real part and the imaginary part respectively of the input impedance of the antenna, and FIG. 3 shows the coefficient of reflection which results therefrom.

Figure 4A:
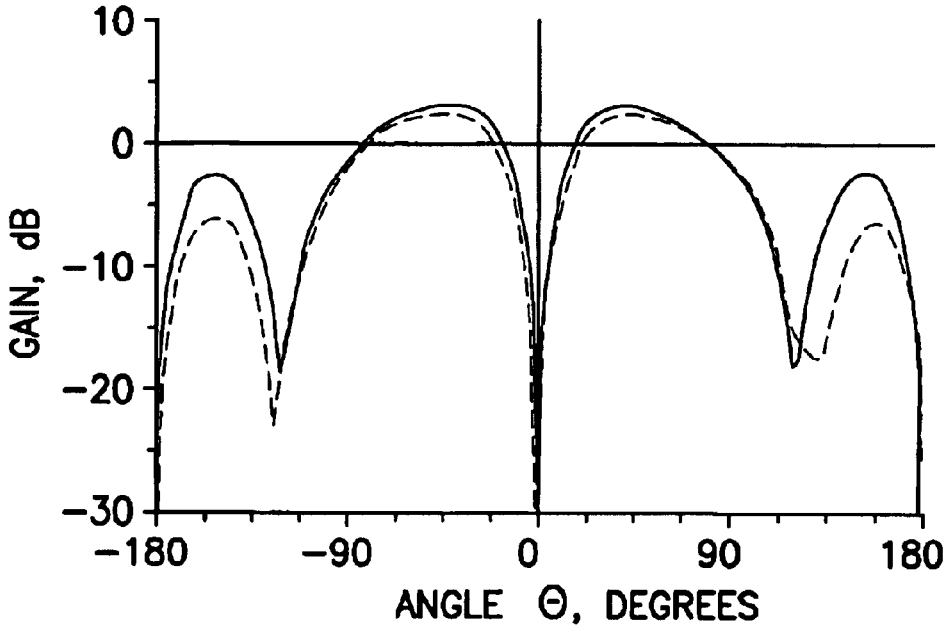
FIGS. 4*a* and 4*b* illustrate, for this same antenna, the gains obtained in the plane of the wires and in the orthogonal plane respectively.
Figure 4B:
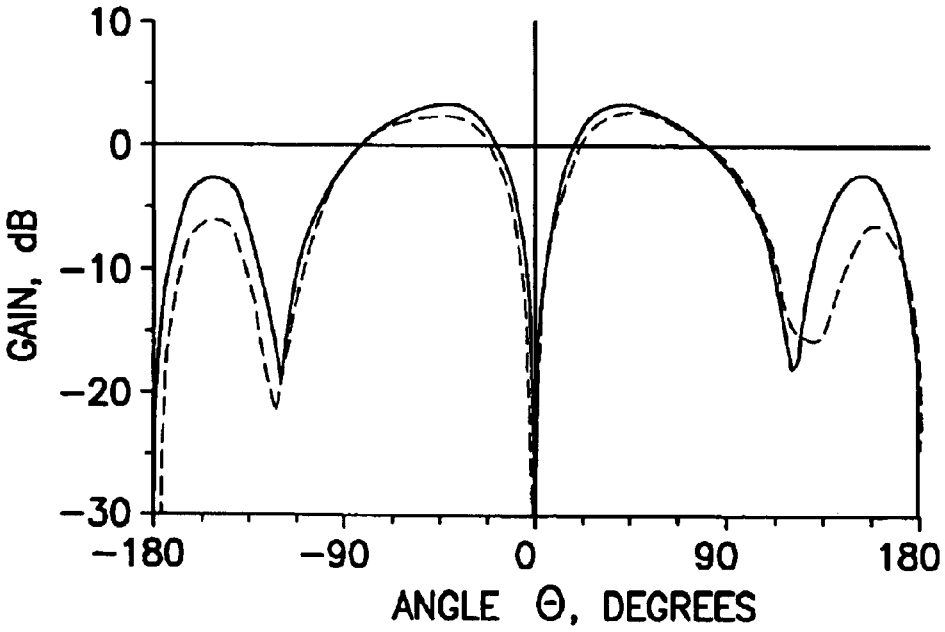

Similarly, FIGS. 4*a* and 4*b* show the gain obtained in the plane of the wires and in the plane orthogonal to the plane of the wires respectively, evaluated over the entire space surrounding the antenna.

These results make it possible to verify the excellent match of the antenna (FIG. 3) as well as the typical shape of the monopole radiation deformed by the diffraction effect of the edges of the ground plane (FIG. 4). The antenna has a coefficient of reflection $S_{11}$ (f) on the order of −20 dB (only 1% of the incident power is reflected) at the frequency of 1.77 GHz.

The gain obtained, which is shown in FIG. 4 at this same frequency of 1.77 GHz, takes into account all the losses (mismatch, ohmic and dielectric losses) and reaches a maximum value of about 2.5 dB at 45°, by reason of the deformation of the radiation pattern due to the dimensions of the ground plane.

In addition to the advantages presented by the double-resonant antenna having a single radiating wire as compared with the prior antennas and which the double-resonant antenna having several radiating wires again has, the multiplication of the radiating wires on this type of antenna presents other advantages.

In fact, the introduction of additional radiating wires permits greater freedom with respect to the physical parameters of the antenna, which permits:

- easier matching of the aerial;
- the possibility of using substrates of strong permittivity;
- a broadening of the pass band: 8% of the band for a SWR of 2 or 20% of the band for a SWR of 5.8 ([$S_{11}$] of −3 dB);
- a physical configuration of the antenna which is not necessarily unique and is easily modulated;
- a perfect symmetrifying of the radiation pattern throughout the entire space.

The technological production of the antenna appears henceforth easier, since the constraints imposed on the physical parameters in order to obtain proper operation are less strict or penalizing.

From the point of view of production, the following advantages are obtained:

- increased strength of the antenna by the introduction of additional radiating wires and of a coaxial probe of large diameter;
- the possibility of producing an antenna without dielectric substrate, the top being held by the assembly of wires;
- the possibility of using dielectric substrates which facilitate the production and reinforce the rigidity of the antenna.

Figure 2A:
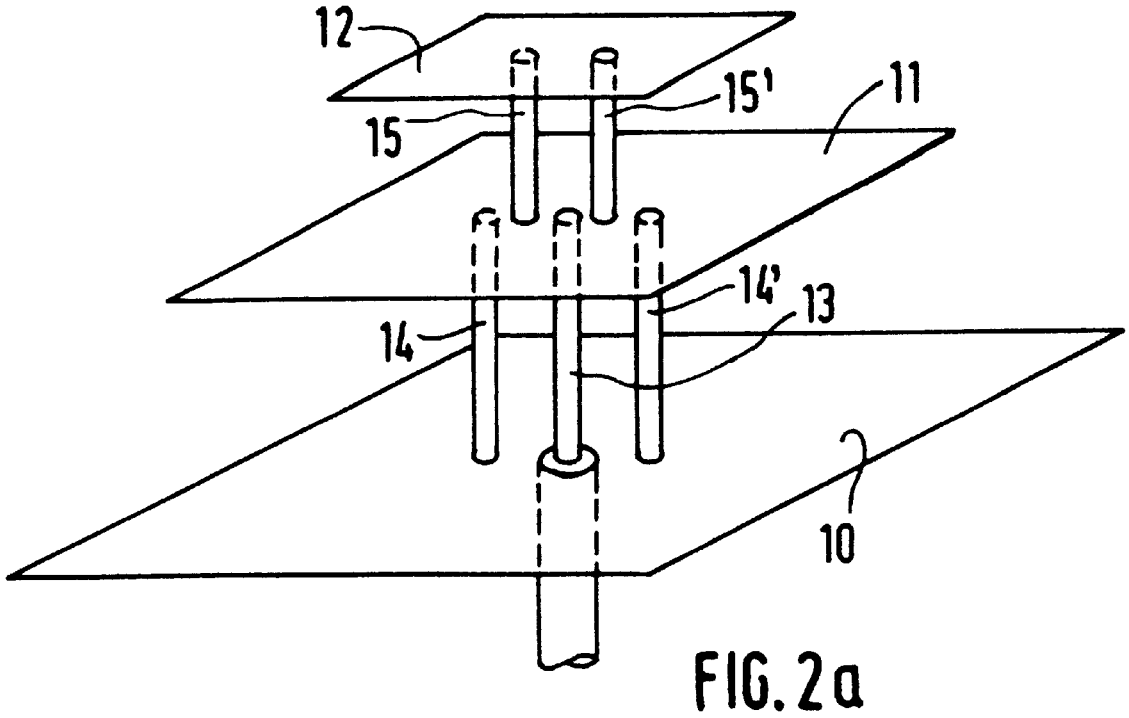

In the embodiment shown in FIG. 2*a*, the dielectric is the ambient air. The ground plane 10 is surmounted by a first capacity top 11, in its turn surmounted by a second capacity top 12. Only the first capacity top 11 is connected to a coaxial feed probe 13 which passes through the ground plane 10 for its connection to a generator.

The first capacity top 11 is furthermore connected to the ground plane 10 by two conductor wires 14 and 14' arranged with respect to the probe 13, in the same manner as the wires 5 of the embodiment in FIG. 1. The second capacity top 12 is connected to the first capacity top 11 by two radiating wires 15 and 15' in contact with the top 11 at two points located between the points of contact of the probe 13 and those of the wires 14 and 14' of the other side of top 11.

It will be seen below that such a device produces two resonant frequencies.

Figure 2B:
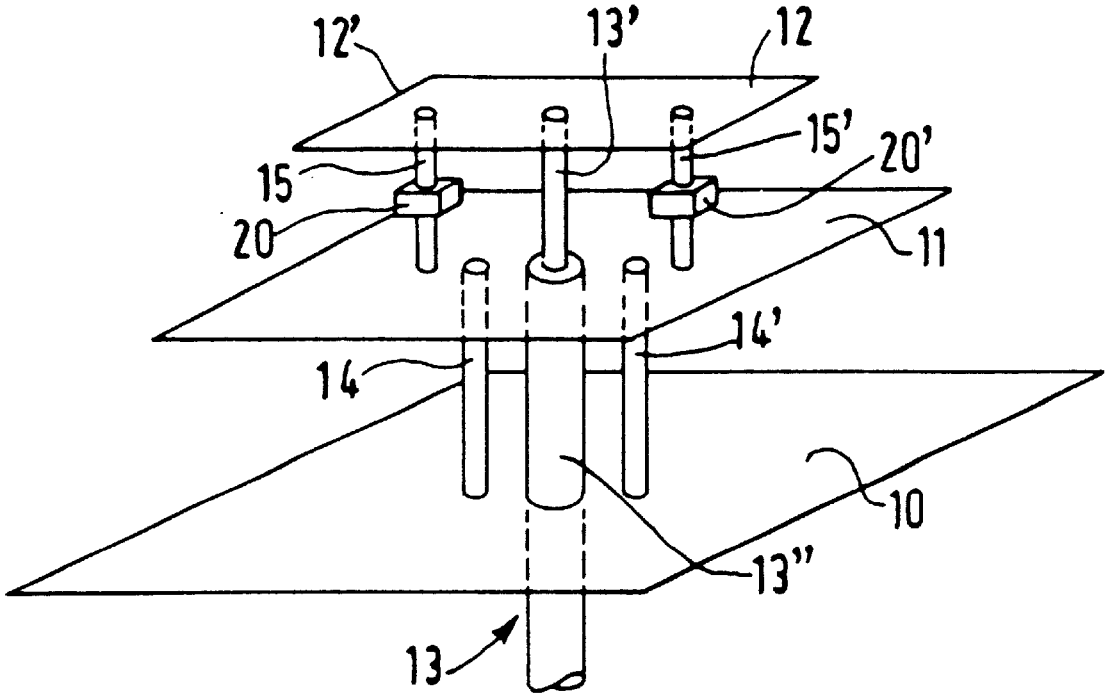

In the embodiment of FIG. 2*b*, the assembly of the probe 13 passes through the ground plane 10. Its outer tubular conductor 13" electrically connects the ground plane 10 to the first capacity top 11, while the central conductor 13' is connected to the upper capacity top 12.

The top 12 in this case has an elongated, rectangular shape. The radiating wires 15 and 15' are connected to the top 12 at places close to the small sides 12' of the top 12.

The wires 15 and 15' are in this case loaded by circuits 20 and 20' having a suitable adequate impedance, active or passive. Of course, a larger number of tops as well as a different arrangement of the radiating wires can be contemplated in the embodiments of FIGS. 2*a* and 2*b*.

It has been possible to note that the shape of the tops is practically arbitrary and that only their surface areas is of importance. For practical and simplifying reasons, the top 10 having the smallest surface can be placed highest up above the ground plane 10, the larger top 11 being placed immediately above the ground plane. Thus, the feed probe is only connected to the larger top 11 through the ground plane. It is therefore the physical parameters related to the lower stage which act primarily on the lowest resonance; the highest resonance, in its turn, in fixed on the one hand by the physical parameters related to the upper stage, but also by those of the bottom stage containing the coaxial feed probe 13.

Thus, while the conditions: to be imposed on the physical parameters relating to the bottom stage are known from the description given above with reference to FIG. 1, they must henceforth be modulated in order not excessively to penalize the highest resonance. In fact, it is necessary to make the second double-resonance exploitable from the standpoint of the matching to 50 ∩, by joint action on, on the one hand, all of the physical parameters related to the first stage and, then, on the other hand, on the physical parameters related to the second stage and which influence both the resonances (namely the dimensions of the upper top 12, the value of the permittivity of the dielectric substrate of the second stage and its thickness), and, finally, action on the physical parameters which act only on the second resonance, independently of the other, namely, the radius of the upper radiating wires 15 and 15' (and the distance between them).

As a whole, it has appeared preferable for the coaxial feed probe 13 to have a large diameter, for the radiating wires 14 and 14' of the bottom stage to be spaced from the coaxial probe 13 and have a radius at least three to four times less than that of the feed probe, and for the radiating wires 15 and 15' of the upper stage to have a diameter identical to or even greater than that of the feed probe and also to be spaced from each other as the wires 14 and 14' are spaced from the probe 13. Furthermore, the location of the wires below the tops is arbitrary and only the distances between them are important; however, a symmetrical centered arrangement makes it possible to make the radiation pattern symmetrical. The respective heights of each of the antennas should preferably be of the same order of magnitude with respect to the wavelength emitted and not exceed $\lambda_o/15$.

The areas of the tops should not be too different if it is desired to retain the close resonances in a ratio of 1.4 with respect to the areas appears to be a maximum which is not to be exceeded. As to the dielectric substrates, they may permit bringing the resonances together or apart as well as modifying the quality coefficients of the resonances.

While the principle of operation of this device adopts that of the double-resonant antenna for each top of the antenna, the phenomenon is, however, complicated due to the presence of lower tops which may act as ground plane with respect to the upper tops. Furthermore, the coupling phenomena take place not only between the wires of the same stage but also with those of the other stages. Thus, the double-resonance phenomenon related to the first stage in which the feed probe is contained is practically independent of the resonances due to the upper stages, but each of the resonances due to the upper stages depends greatly on those related to the lower stages.

Although, in this case, the establishing of an equivalent circuit would appear difficult, the appearance of the parallel resonances, located far below the conventional cavity resonance modes of printed antennas, always results from a short circuit produced via the radiating wires (and possibly the tops and the lower radiating wires) at the level of the capacitances presented by each top of the device.

These properties are general and are found again with antenna physical parameters very different from any signal frequencies.

The double-resonant antenna with multiple radiating elements can be employed in two: different manners: it is either used as a device having a broad pass band, and in this case the characteristics of each superposed element must lead to the overlapping of the operating frequency bands of each of the antennas in order to realize a matching to 50 ∩ broad band. Or this type of aerial is used as a device with several resonance frequencies but with identical pattern of radiation and, in this case, each of the operating frequency bands must be different from the adjacent bands.

However, whatever the desired manner of use of the device, correct operation of the device can be obtained in the manner set forth below. Due to the large number of physical parameters to be fixed, and taking into account the fact that certain parameters modify all of the resonances, it is important to proceed by stages and to commence by fixing the physical parameters which have a large influence. Thus, it is necessary first of all to see to selecting the parameters related to the lower stage containing the feed probe and then select, stage by stage, the physical parameters relating primarily to each of the resonances in order to optimize the matching of the device to 50 ∩.

One therefore proceeds in the following manner:

one selects the dimensions of the tops, the heights, the substrates and the number of radiating wires with respect to each stage, which gives the approximate operating frequencies;

one selects the location of the wires, their radius, and the distance between them concerning the stage in which the coaxial feed probe or probes is or are located while readjusting the physical parameters of the other stages which have an effect on the total resonances, namely the dimensions of the tops, the heights, and the value of the dielectric permittivity of the substrate; there results from this an adjustment of the resonance frequencies which is associated with a precise positioning of the real and imaginary parts of the impedance concerning solely the resonance relating to the stage which contains the feed probe, which makes it possible to optimize the matching of the device to this first frequency.

Thereupon, for each of the tops forming part of the device, commencing with the stage located immediately above the preceding one:

one selects the position of the wires, their radius, and the distances between them in such a manner as to modify only the resonance related to such stage and those related to the upper stages, hence an adjustment of the resonance frequency concerned, and of the real and imaginary parts of the impedance in order to optimize the matching of the device to this frequency. The upper resonances can possibly be modified, but they will be modified again upon the optimizing of the parameters concerning them;

finally, one selects dimensions of the ground plane in order to determine the radiation patters.

The radiation of the device takes place essentially via the wires placed at the level of each of the superimposed double-resonant antennas. Thus, the radiation produced by the device presents characteristics identical to the radiation of a monopole.

However, it is to be noted that the device shows remarkable stability of the radiation pattern as a function of the frequency since the "double-resonance" phenomena are located far below the cavity resonance modes of printed antennas.

However, slight changes in the radiation pattern can be observed when the frequency varies substantially due to diffraction by the edges of the ground plane, the effects of which vary with the wavelength, as is the case for all monopole radiation antennas.

FIGS. 5 and 6 illustrate the results obtained with an antenna of the type shown in FIG. 2 in which the ground plane 10 has dimensions of 99 mm×99 mm, the lower capacity top 11 has dimensions of 39 mm×39 mm, and the upper capacity top 12 has dimensions of 26 mm×26 mm. The capacity top 11 is spaced 10 mm from the ground plane 10 and the two capacity tops 11 and 12 are also 10 mm apart. The coaxial feed probe 13 as well as the radiating wires 15 and 15' have a diameter of 1.27 mm, and the radiating wires 14 and 14' have a diameter of 0.4 mm. The wires 3 and 4 are 6.6 mm apart and the wires 14 and 14' are each 9.9 mm from the feed probe 13.

The resonant frequencies of the fundamental resonant cavity type mode of each of the two superimposed antennas are located at about 3.8 GHz and 5.7 GHz respectively. The position of the wires could be determined in such a manner as also to permit operation of the antenna on the resonant modes.

The theoretical results are shown in solid line in FIGS. 5 and 6, and the experimental results in dashed lines.

Figure 5A:
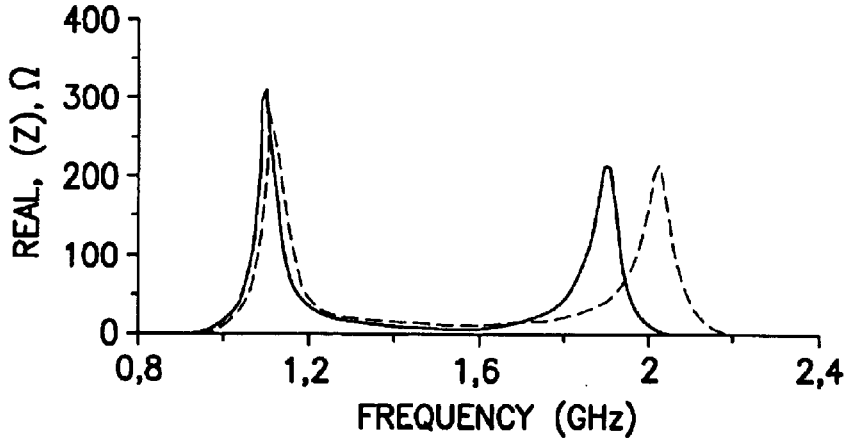
FIGS. 5*a*, 5*b* and 5*c* illustrate the real and imaginary parts of the impedance Z (f) and the coefficient of reflection $S_{11}$ (f) respectively of an antenna in accordance with the embodiment shown in FIG. 2.
Figure 5B:
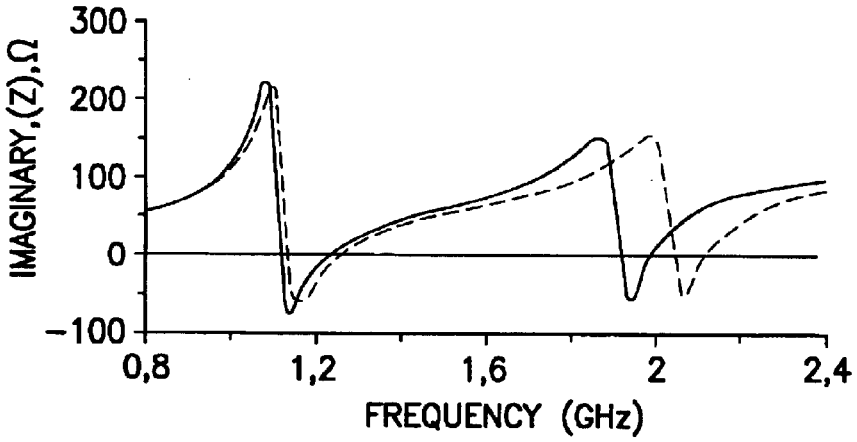
Figure 5C:
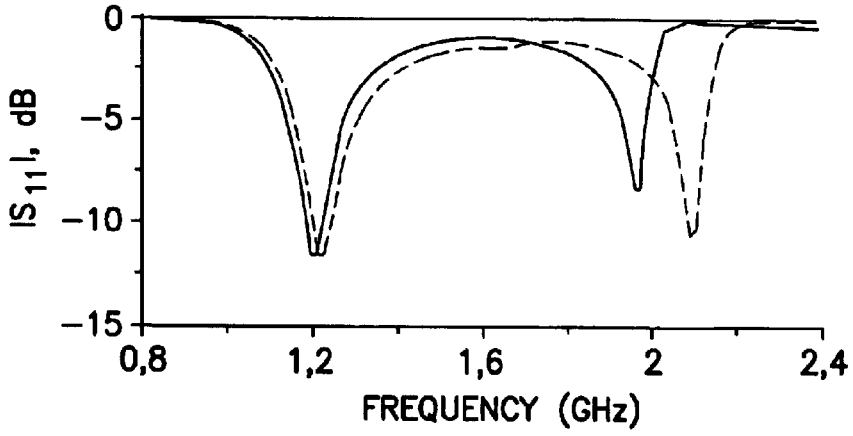
Figure 6A:
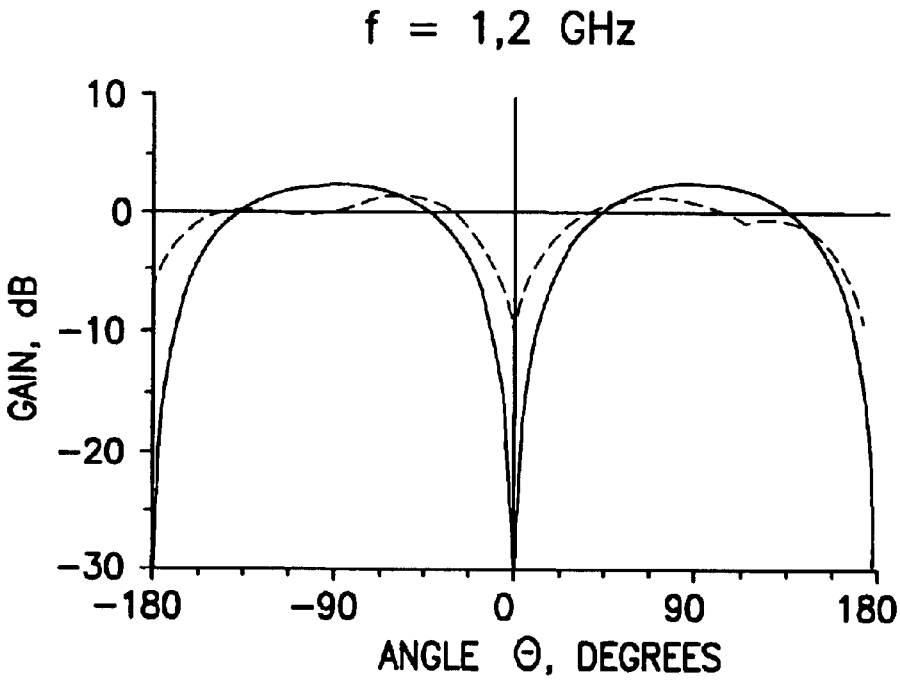
FIGS. 6*a* and 6*b* illustrate for this same antenna the gains obtained in the plane of the wires at different frequencies.
Figure 6B:
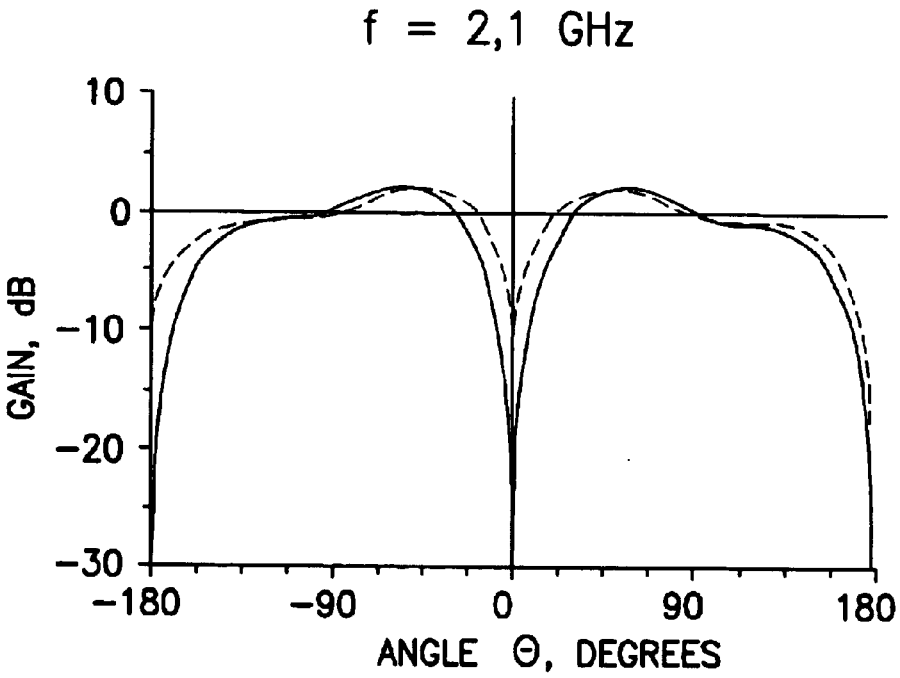

FIG. 5 shows the electrical characteristics of the antenna, namely the real and imaginary parts of the input impedance (FIGS. 5*a* and 5*b*), and the coefficient of reflection measured with respect to 50 ohms (FIG. 5*c*). FIGS. 6*a* and 6*b* show the gain produced by the antenna obtained in the plane of the wires and evaluated throughout the entire space surrounding the antenna at the two operating frequencies of 1.2 GHz and 2.1 GHz respectively.

The antenna then has two "double resonances" located at about 1.1 GHz and 2 GHz. Incomplete optimizing of the physical parameters of the antenna makes it possible moreover to obtain two coefficients of reflection on the order of −12 dB at 1.2 GHz and 2.1 GHz. The difference observed at the level of the determination of the high resonance frequency is due to a slightly different practical development of the antenna designed in theory.

At the two operating frequencies there is then observed a radiation of monopole type which is slightly deformed by the diffraction due to the ground plane. It will be noted that the pattern which is most deformed is the one evaluated at the highest frequency, but that the front radiation of the antenna (−90°<0<90°) is practically identical at the two operating frequencies separated by 0.9 GHz (experimental curves).

The values of the gain obtained at the two operating frequencies, namely 1.4 dB at f=1.2 GHz and 1.9 dB at f=21 GHz (experimental curves) are in accord with the values expected in view of the match at −12 dB obtained at these frequencies and could be increased by means of an optimized matching to 50 ∩.

The radiation obtained in the plane orthogonal to the plane of the wires gives identical results which are not presented here.

This multiple-stage device permits the creation of multiple "double resonances", whether located close to each other or not. Thus, such a device immediately presents two main points of interest:

- a matching to 50 ∩ very broad band obtained by overlap of the pass bands relating to each of the superimposed antennas. 75% of the band pass for a $[S_{11}]$ of −3 dB was obtained with only two superimposed antennas.
- a matching to microwave generators on different frequency bands which are close to or distant from each other.

Furthermore, the technique of superimposing double-resonant antennas makes it possible for the complete device to retain in full the characteristics of the double-resonant antenna and, in particular, the advantages set forth above.

Furthermore, a radiation of monopole type which is practically stable as a function of the frequency will be obtained.

We claim:

1. A monopole wire-plate antenna having a working frequency, and comprising a ground plane, a first radiating element in the form of a capacity top adapted to be directly connected to a generator or to a receiver via a feed wire, and a second radiating element in the form of a plurality of conductor wires connecting the capacity top to the ground plane characterized by the fact that the antenna comprises a plurality of at least one of said radiating elements, wherein, the antenna having a working wavelength λ, the dimensions of the capacity top are roughly λ.8 by λ.8 that is sufficiently small relative to said wavelength, whereby the antenna operates by monopolar radiation at the working frequency in which at least one of the wires is loaded with a circuit element.

2. An antenna according to claim 1, comprising a plurality of radiating wires.

3. An antenna according to claim 2, in which the radiating wires are arranged symmetrically with respect to the feed wire.

4. An antenna according to claim 1, having a plurality of capacity tops, at least one of the capacity tops being adapted to be connected to the generator.

5. An antenna according to claim 4 fed by a coaxial probe having said feed wire and an outer conductor, which coaxial probe passes through the ground plane, the feed wire of the coaxial probe is connected to a capacity top and the outer conductor of the coaxial probe connects the ground plane to a capacity top located between said ground plane and the capacity top connected to the feed wire.

6. An antenna according to claim 1 comprising at least two capacity tops and adapted to have a broad pass band.

7. An antenna according to claim 1, comprising a plurality of capacity tops and adapted to have a plurality of resonant frequencies.

8. An antenna according to claim 1, in which the capacity top is substantially rectangular and the radiating wire is connected to a short side of the rectangle.

* * * * *